US006574809B1

(12) United States Patent
Rathbun

(10) Patent No.: US 6,574,809 B1
(45) Date of Patent: Jun. 10, 2003

(54) PILLOW

(76) Inventor: Gordon Rathbun, 1720 Meadowvale Dr., South Lake Tahoe, CA (US) 96150

( * ) Notice: Subject to any disclaimer, the term of this patent is extended or adjusted under 35 U.S.C. 154(b) by 0 days.

(21) Appl. No.: 09/679,798

(22) Filed: Oct. 5, 2000

Related U.S. Application Data

(60) Provisional application No. 60/157,966, filed on Oct. 6, 1999.

(51) Int. Cl.[7] ..... A47G 9/00

(52) U.S. Cl. ..... 5/636; 5/640

(58) Field of Search ..... 5/636, 638, 637, 5/644, 640, 643, 645; D6/601

(56) References Cited

U.S. PATENT DOCUMENTS 2,700,779 A * 2/1955 Tolkowsky ..... 5/636
D315,468 S * 3/1991 Jenney ..... D6/601
5,528,784 A * 6/1996 Painter ..... 5/636
5,708,998 A * 1/1998 Torbik ..... 5/636
D401,795 S * 12/1998 Liao ..... D6/601
5,848,448 A * 12/1998 Boyd ..... 5/636
5,926,879 A * 7/1999 Davis ..... 5/636
5,926,880 A * 7/1999 Sramek ..... 5/636
D421,359 S * 3/2000 Liao ..... D6/601

OTHER PUBLICATIONS

International Search Report for PCT/US00/27791; Apr. 11, 2001; Patent Cooperation Treaty—International Searching Authority.

* cited by examiner

*Primary Examiner*—Alexander Grosz
(74) *Attorney, Agent, or Firm*—Robert B. Reeser, III; Armstrong Teasdale LLP

(57) ABSTRACT

A pillow supports a person's head while the person sleeps on their side and does not induce any pressure to a person's face. The pillow includes a body which has a first body portion and a second body portion extending from the first body portion. The first body portion is substantially rectangular-shaped and provides a base for the second body portion. The second body portion defines at least one recess and is positioned such that a plurality of recesses extend from the sides of the pillow towards a lower section of the second body portion.

20 Claims, 4 Drawing Sheets

PILLOW

CROSS REFERENCE TO RELATED APPLICATION

This application claims the benefit of U.S. Provisional Application No. 60/157,966, filed Oct. 6, 1999, which is hereby incorporated by reference in its entirety.

BACKGROUND OF THE INVENTION

This invention relates generally to pillows and, more particularly, to pillows which reduce wrinkles on a person's face while resting on the pillow.

Despite a plurality of skin care products, when a person sleeps on their side and rests their head on a pillow, the pillow may accelerate facial wrinkling especially in the delicate skin areas surrounding the eyes, cheeks, and nose. Known pillows apply a uniform amount of support across the pillow. Pillow designs typically include a pliable body which includes foam, air, fluids, rubber, or feathers and which is symmetrical to provide a pre-selected amount of support uniformly across the body of the pillow. As a result, when a person sleeps on their side, the pillow simultaneously supports the person's face and head. The resulting pressure induced on the person's face may create stress lines or creases which over time may accelerate the person's facial wrinkling.

BRIEF SUMMARY OF THE INVENTION

In an exemplary embodiment, a pillow supports a person's head while the person sleeps on their side, without inducing any pressure to a person's face resting on the pillow. The pillow includes a body including a first body portion and a second body portion extending from the first body portion. The first body portion is substantially rectangular-shaped and provides a base for the substantially T-shaped second body portion. The second body portion includes a plurality of recesses extending from the sides of the pillow towards a lower section of the second body portion.

Each recess permits a person to sleep on their side with their head supported by an upper section of the second body portion while their face is suspended above the recess. Because the person's face is not supported by the pillow, facial wrinkling is reduced while the person is asleep. Accordingly, a pillow is provided which comfortably supports a person's head while they sleep and does not accelerate facial wrinkling.

DETAILED DESCRIPTION OF THE INVENTION

Figure 1:
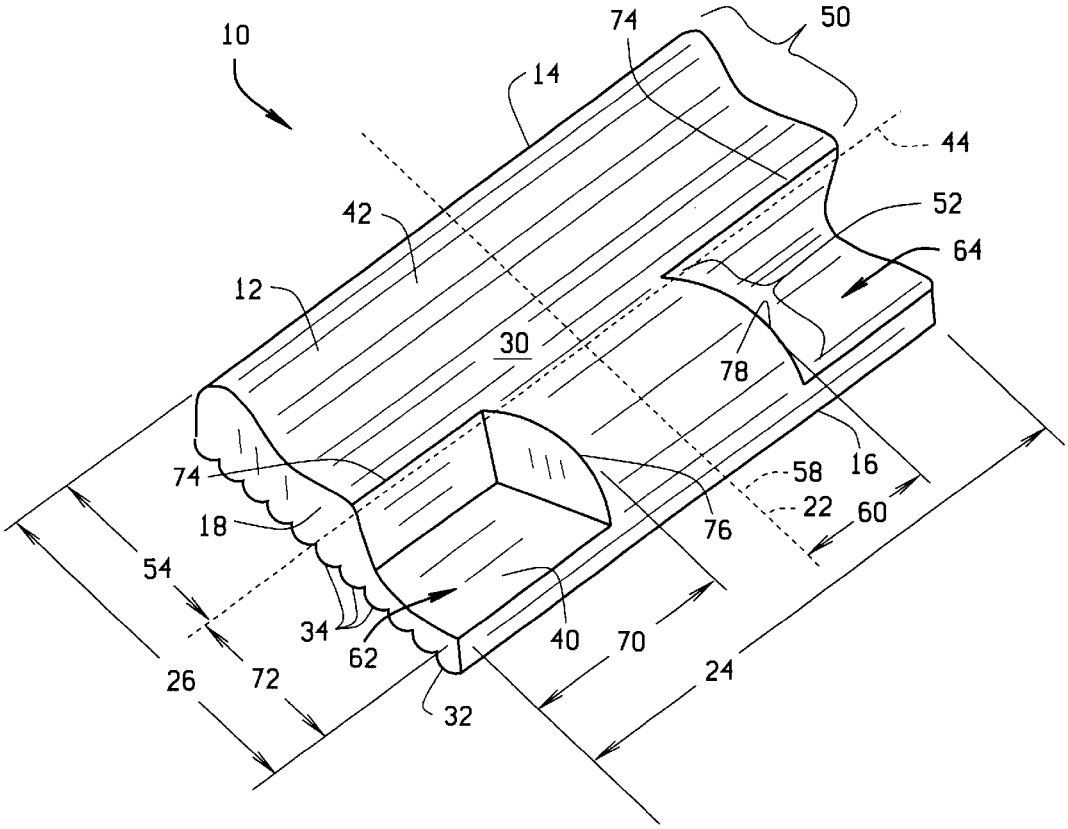
FIG. 1 is perspective view of a pillow.

FIG. 1 is a perspective view of a pillow 10 including a pliable body 12. Pillow 10 is substantially rectangular in shape and includes a top edge 14, a bottom edge 16 connected to top edge 14 with a first side 18 and a second side (not shown in FIG. 1), and an axis of symmetry 22 extendings from top edge 14 to bottom edge 16. Pillow 10 includes a width 24 extendings between first side 18 and the second side and a length 26 extendings between top edge 14 and bottom edge 16. A top surface 30 extends from first side 18 to the second side and from top edge 14 to bottom edge 16. A bottom surface 32 extends from first side 18 to the second side and from top edge 14 to bottom edge 16. Bottom surface 32 includes a plurality of ridges 34 extending from first side 18 to the second side.

Body 12 is unitary and includes a first body portion 40 and a second body portion 42 extending from first body portion 40. First body portion 40 and second body portion 42 are fabricated from the same material (not shown). In one embodiment, first body portion 40 and second body portion 42 are constructed from a pliable material including foam rubber sponge or fiber material. In a second embodiment, first body portion 40 and second body portion 42 is be constructed from a down material.

First body portion 40 is substantially rectangular in shape and includes bottom surface 32 and an axis of symmetry 44. Axis of symmetry 44 extends from pillow first side 18 to the pillow second side and is substantially perpendicular to pillow axis of symmetry 22.

Second body portion 42 is substantially T-shaped and includes a first section 50 and a second section 52. In one embodiment, pillow second section 52 is a bladder construction which may be filled with air or fluid. First section 50 extends from first side 18 to the second side. Second body first section 50 has a length 54 extending from top edge 14 to second body portion second section 52. First section length 54 is less than pillow length 26. Top surface 30 extends over second body first section 50 and is a concave depression extending from first side 18 to the second side. Alternatively, second body portion first section 50 is constructed with top surface 30 being substantially flat.

Second body portion second section 52 extends from first section 50 to bottom edge 16. Second body portion second section 52 includes an axis of symmetry 58 substantially co-linear with pillow axis of symmetry 22. Top surface 30 extends over second section 52 and extends in a convex arch-like projection for a width 60. Width 60 extends between a first recess 62 and a second recess 64 and is less than pillow width 24.

Second body portion second section 52 supports a head (not shown in FIG. 1) of a person (not shown in FIG. 1) sleeping. When a person is sleeping on their back, facial wrinkling is not induced and second section concave top surface 30 supports the head and neck of the person sleeping. However, when a person sleeps on their side, delicate facial skin is placed in contact with a pillow. Pillow 10 includes recesses 62 and 64 extending from second body portion second section 52 to first side 18 and the second side respectively. In one embodiment, second body portion second section 52 includes a pair of depressions (not shown) adjacent recesses 62 and 64, and extending into pillow 10 approximately 0.5 inches to receive a person's ear (not shown).

Each recess 62 and 64 has a width 70 extending from second section 52 to first side 18 and the second side, respectively, and a length 72 extending from second body portion first section 50 to bottom edge 16. Accordingly, each recess 62 and 64 and second body portion second section 52 permit a person to sleep on their side with their head supported by second body portion second section 52 while their face (not shown) is suspended above recesses 62 and 64. Because the person's face is not in contact with pillow 10, facial wrinkling is alleviated while the person is asleep.

Recess 62 is bordered by a lower edge 74 of second body portion first section 50 and a first edge 76 of second body portion second section 52. Recess 64 is bordered by lower edge 74 of second body portion first section 50 and a second edge 78 of second body portion second section 52.

Figure 2:
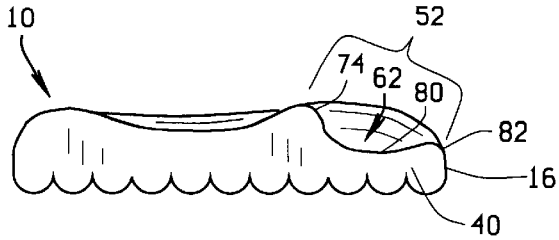
FIG. 2 is side elevational view of the pillow shown in FIG. 1.

FIG. 2 is side elevational view of pillow 10 including recess 62. Second body portion first section lower edge 74 borders recess 62 and is rounded to remove any sharp corners which may cause discomfort to the person (not shown in FIG. 2) sleeping. Recess 62 also includes a top surface 80 of first body portion 40. Top surface 80 is concave extending from second body portion first section 52 to pillow bottom edge 16. Alternatively, pillow 10 is fabricated such that top surface 80 is substantially flat between bottom edge 16 and second body portion first section 52. Bottom edge 16 includes a top edge 82 which is rounded to remove any sharp corners which may cause any discomfort to the person sleeping on pillow 10. Recess 64 is constructed identically to recess 62.

Figure 3:
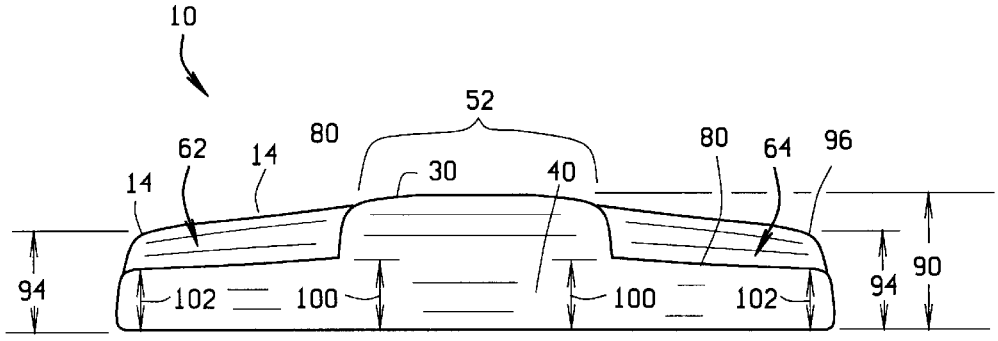
FIG. 3 a front elevational view of the pillow shown in FIG. 1.

FIG. 3 is a front elevational view of pillow 10 including bottom edge 16. Pillow 10 has a first thickness 90 extending between pillow top surface 30 to pillow bottom surface 32. First thickness 90 extends along pillow axis of symmetry 22 (shown in FIG. 1) between pillow top edge 14 and pillow bottom edge 16. Pillow 10 has a second thickness 94 extending between pillow top surface 30 and pillow bottom surface 32. Pillow second thickness 94 extends along first side 18 and a pillow second side 96 between pillow top edge 14 and pillow bottom edge 16. Second thickness 94 is smaller than first thickness 90 such that pillow 10 is tapered symmetrically from axis of symmetry 22 to first side 18 and second side 96. Tapering pillow 10 provides additional comfort to the person (not shown in FIG. 3) sleeping on their side on pillow 10. Additionally, tapering pillow 10 permits gravity to pull the person's face downward while the person is sleeping on their side and further reduce wrinkling of the person's face.

Recess 62 has a first thickness 100 extending between top surface 80 of first body portion 40 and pillow bottom surface 32. First thickness 100 extends within recess 62 adjacent second body portion second section 52. Recess 62 has a second thickness 102 at pillow first side 18 which is less than thickness 100 such that top surface 80 slopes from second body portion second section 52 to pillow first side 18. Recess 64 is constructed identically and includes first thickness 100 and second thickness 102.

Figure 4:
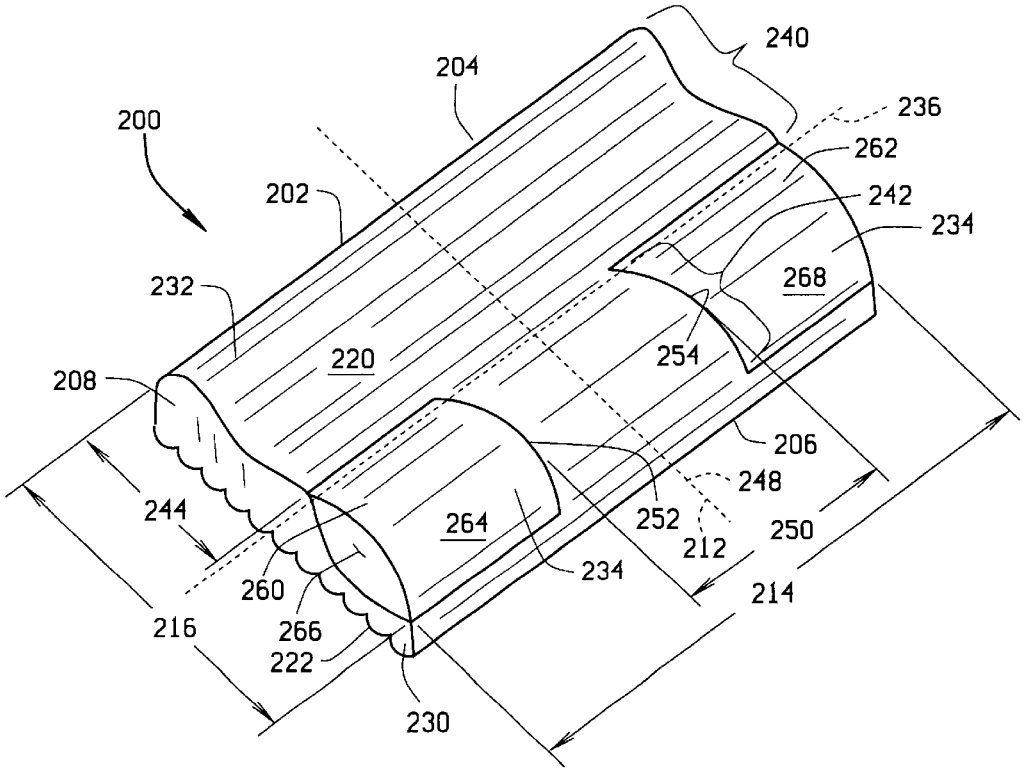
FIG. 4 is a perspective view of an alternative embodiment of a pillow.

FIG. 4 is a perspective view of an alternative embodiment of a pillow 200 including a body 202. Pillow 200 is substantially rectangular in shape and includes a top edge 204, a bottom edge 206 connected to top edge 204 with a first side 208 and a second side (not shown), and an axis of symmetry 212 extending from top edge 204 to bottom edge 206. Pillow 200 includes a width 214 extending between first side 208 and the second side and a length 216 extending between top edge 204 and bottom edge 206. A top surface 220 extends from first side 208 to the second side and from top edge 204 to bottom edge 206. A bottom surface 222 extends from first side 208 to the second side and from top edge 204 to bottom edge 206. Bottom surface 222 includes a plurality of ridges 224 extending from first side 208 to the second side.

Body 202 includes a first body portion 230, a second body portion 232, and a third body portion 234. Second body portion 232 extends from first body portion 230 and first body portion 230 and second body portion 232 are each fabricated from a material (not shown) which is dense and provides a desired level of support to pillow 200.

First body portion 230 is substantially rectangular in shape and includes bottom surface 222 and an axis of symmetry 236. Axis of symmetry 236 extends from pillow first side 208 to the pillow second side and is substantially perpendicular to pillow axis of symmetry 212.

Second body portion 232 is substantially T-shaped and includes a first section 240 and a second section 242. First section 240 extends from first side 208 to the second side. Second body first section 240 has a length 244 extending from top edge 204 to second body portion second section 242. First section length 244 is less than pillow length 216.

Second body portion second section 242 extends from second body portion first section 240 to pillow bottom edge 206. Second body portion second section includes an axis of symmetry 248 which is substantially co-linear with pillow axis of symmetry 212. Second section 242 has a width 250 extending from a first edge 252 of second section 242 to a second edge 254 of second section 242. Width 250 is less than pillow width 214 which creates a first recess (not shown) extending from pillow first side 208 to second body portion second section 242 and from second body portion first section 240 to pillow bottom edge 206. A second recess (not shown) is identical to the first recess and extends from the pillow second side to second body portion second section 242 and from second body portion first section 240 to pillow bottom edge 206. In one embodiment, second body portion second section 242 includes a pair of depressions (not shown) adjacent the first and second recesses, and extending into pillow 200 approximately 0.5 inches to receive a person's ear (not shown).

Third body portion 234 includes a first insert 260 and a second insert 262 fabricated from a second material (not shown) that is different from the material used in fabricating first body portion 230 and second body portion 232. The second material used in fabricating third body portion 234 is less dense than the first material used in fabricating first body portion 230 and second body portion 232 and does not provide support to the person (not shown in FIG. 4) sleeping on pillow 200. Rather, third body portion 234 provides an aesthetic appearance to pillow 200 when a standard pillow case (not shown) is installed over pillow 200.

First insert 260 is attached to pillow 200 and is positioned within the first recess. First insert 260 includes a top surface 264 extending from second body portion first section 240 to pillow bottom edge 206 and is substantially co-planar with pillow top surface 220. First insert 260 also includes a side 266 which is substantially co-planar with pillow first side 208.

Second insert 262 is constructed identically to first insert 260 and includes a top surface 268 which is substantially co-planar with pillow top surface 220 and a side (not shown) which is substantially co-planar with the pillow second side.

Top surface 220 extends over second body portion 232. Top surface 220 is concave over second body portion first section 240 and is convex over second body portion second section 242 which creates a valley-like depression over second body portion first section 240 and an arch-like projection over second body portion second section 242.

Second body portion second section 242 supports a head (not shown in FIG. 4) of the person sleeping. When the person is sleeping on their back, second section concave top surface 30 supports the head and neck of the person sleeping. When the person sleeps on their side, second section concave top surface 30 supports the head of the person while the person's face lightly abuts third body portion inserts 260 and 262. Because the person's face is only in light contact with third body portion inserts 260 and 262, and because third body portion inserts 260 and 262 are fabricated from material intended to provide little or no support to pillow 200, facial wrinkling is alleviated while the person is asleep.

Figure 5:
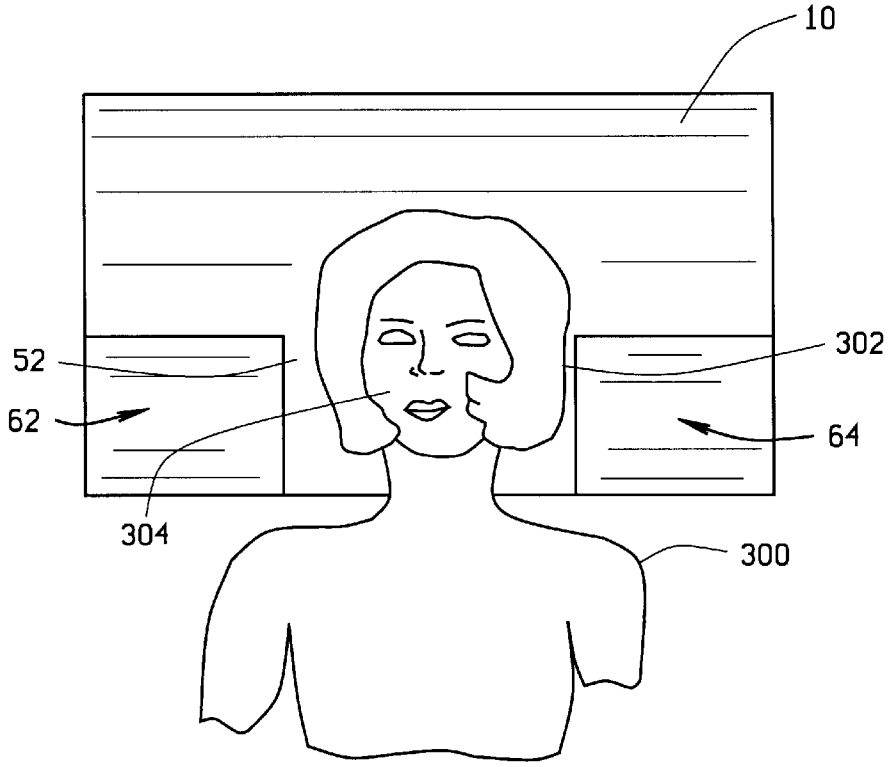
FIG. 5 is a planar view of a person lyingon their back and on the pillow shown in FIG. 1.
Figure 6:
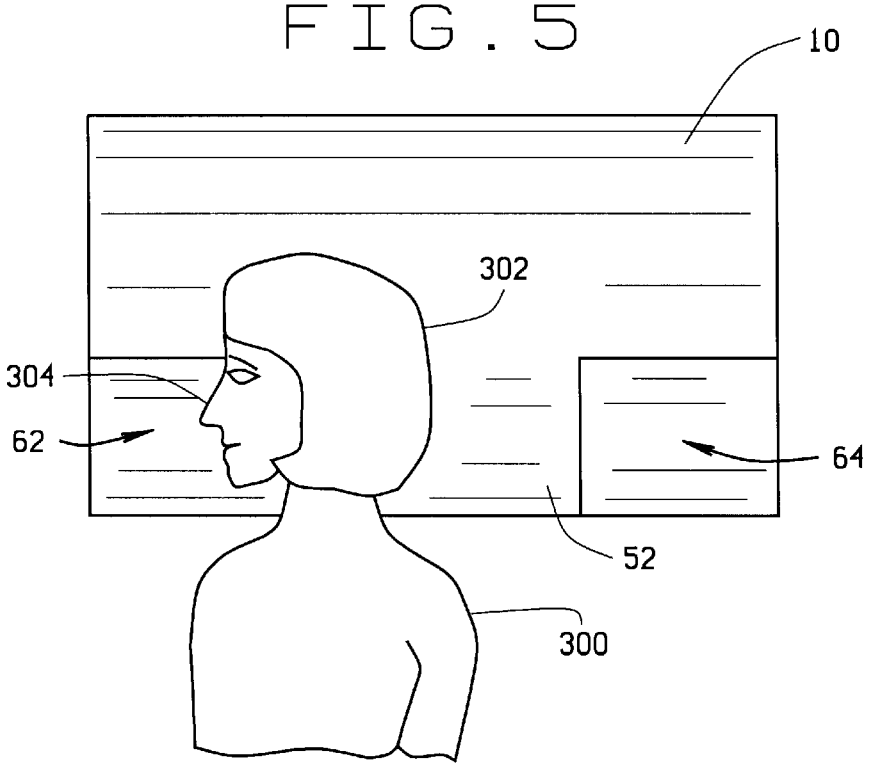
FIG. 6 is a planar view of a person lyingon their side and on the pillow shown in FIG. 1.

FIG. 5 is a planar view of a person 300 lying on their back with their head 302 supported on pillow 10 and FIG. 6 is a planar view of person 300 lying on their side with their head 302 on pillow 10. When person 300 is sleeping on their back, head 302 is supported by pillow second section concave top surface 30 and as such, a person's face 304 is not in contact with pillow 10 and facial wrinkling is not induced.

When person 300 sleeps on their side, recesses 62 and 64 and second body portion second section 52 permit person 300 to sleep on their side with their head 302 supported by second body portion second section 52 while their face 304 is suspended above recesses 62 and 64. Because face 304 is not in contact with pillow 10, facial wrinkling is alleviated while person 300 is a sleep.

Figure 7:
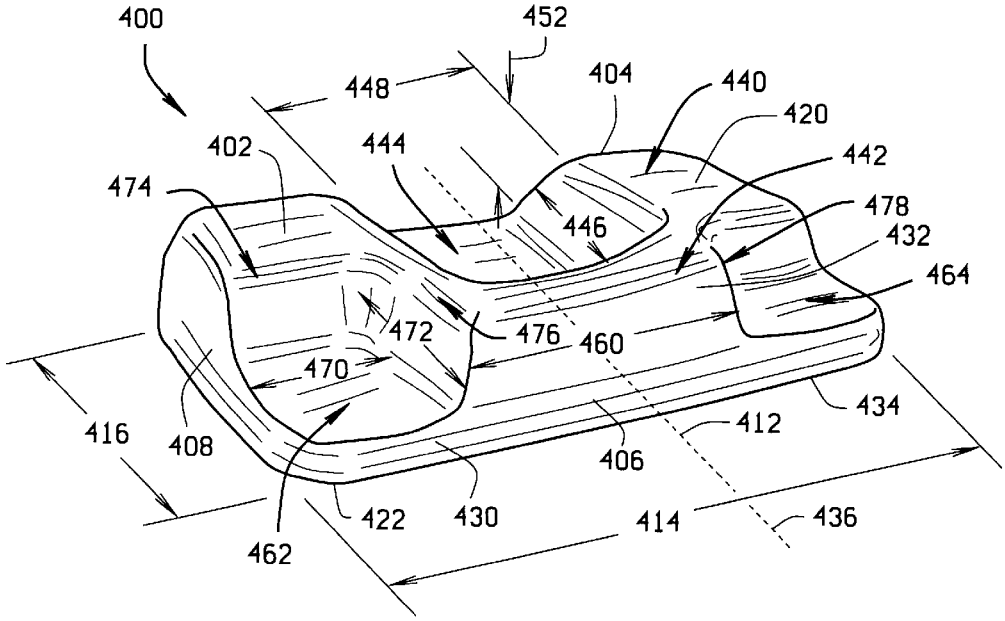
FIG. 7 is a perspective view of another alternative embodiment of the pillow shown in FIG. 1.

FIG. 7 is a perspective view of a pillow 400 including a pliable body 402. Pillow 400 is substantially rectangular in shape and includes a top edge 404, a bottom edge 406 connected to top edge 404 with a first side 408 and a second side (not shown), and an axis of symmetry 412 extending from top edge 404 to bottom edge 406. Pillow 400 has a width 414 extending between first side 408 and the second side, and a length 416 extending between top edge 404 and bottom edge 406. A top surface 420 is substantially planar and extends from first side 408 to the second side and from top edge 404 to bottom edge 406. A bottom surface 422 is substantially planar and extends from first side 408 to the second side and from top edge 404 to bottom edge 406. In one embodiment, pillow 400 is a bladder construction which may be filled with air or fluid.

Body 402 is unitary and includes a first body portion 430 and a second body portion 432 extending from first body portion 430. First body portion 430 and second body portion 432 are fabricated from the same material (not shown). In one embodiment, first body portion 430 and second body portion 432 are constructed from a pliable material which may include foam rubber sponge or fiber material. In a second embodiment, first body portion 430 and second body portion 432 are constructed from a down material.

First body portion 430 is substantially rectangular in shape and includes bottom surface 434 and an axis of symmetry 436. Axis of symmetry 436 extends from pillow first side 408 to the pillow second side and is substantially perpendicular to pillow axis of symmetry 412.

Second body portion 432 is substantially T-shaped and includes first section 440, a second section 442, and a depressed section 444. First section 440 extends from first side 408 to the second side. Depressed section 444 extends from pillow top edge 404 into second body portion second section 442 towards pillow bottom edge 406. More specifically, depressed section 444 extends from pillow top edge 404 towards bottom edge 406 for a length 446. Depressed section length 446 is less than pillow length 416. Additionally, depressed section 444 has a width 448 that is less than pillow width 414.

Depressed section 444 extends into pillow 400 from top surface 420 towards bottom surface 422 for a depth 452. In one embodiment, depressed section depth 452 is approximately equal 1.0 inch.

Second body portion second section 442 extends from first section 440 to pillow bottom edge 406. Top surface 420 extends over second section 442 to pillow bottom edge 406, and over a width 460 of second body portion second section 442. Second body portion second section width 460 is larger than depressed section width 448, and is measured between a first recess 462 and a second recess 464. Accordingly, second body portion second section width 460 is less than pillow width 414.

Second body portion second section 52 (shown in FIG. 1) supports a neck (not shown in FIG. 7) of a person (shown in FIG. 5) sleeping when their head (shown in FIG. 5) is supported within depressed section 444. When a person is sleeping on their back, facial wrinkling is not promoted and second section top surface 420 supports the neck of the person sleeping. However, when a person sleeps on their side, delicate facial skin is placed in contact with pillow 400. Pillow 400 includes recesses 462 and 464 extending from second body portion second section 442 to pillow first side 408 and the pillow second side respectively. In one embodiment, pillow second body portion second section 442 includes a pair of depressions (not shown) adjacent recesses 462 and 464, and extending into pillow 400 approximately 0.5 inches to receive a person's ear (not shown).

Each recess 462 and 464 has a width 470 extending from second section 442 to pillow first side 408 and the pillow second side, respectively, and a length 472 extending from second body portion first section 440 to pillow bottom edge 406. Accordingly, each recess 462 and 464, and second body portion second section 442 permit a person to sleep on their side with their head supported by second body portion second section 442 while their face (not shown) is suspended above recesses 462 and 464. Because the person's face is not in contact with pillow 400, facial wrinkling is alleviated while the person is asleep.

Recess 462 is bordered by a lower edge 474 of second body portion first section 440 and a first edge 476 of second body portion second section 442. Recess 464 is bordered by lower edge 474 of second body portion first section 440 and a second edge 478 of second body portion second section 442.

Figure 8:
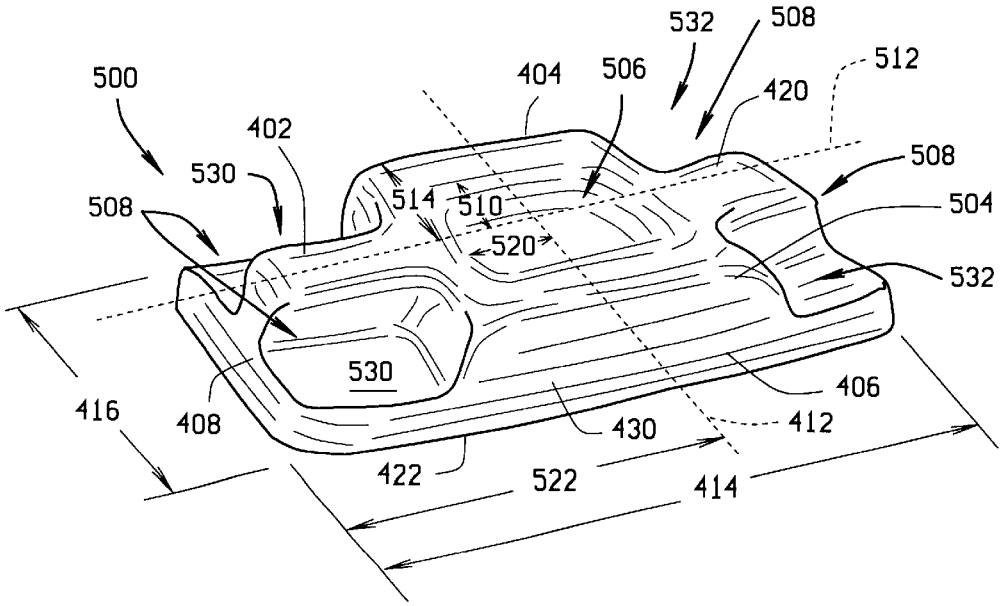
FIG. 8 is a perspective view of a further alternative embodiment of the pillow shown in FIG. 1.

FIG. 8 is a perspective view of a pillow 500. Pillow 500 is substantially similar to pillow 400 shown in FIG. 7 and components in pillow 500 that are identical to components of pillow 400 are identified in FIG. 8 using the same reference numerals used in FIG. 7. Accordingly, pillow 500 includes pliable body 402, top edge 404, bottom edge 406, first side 408, and a second side (not shown). Additionally, pillow 500 has axis of symmetry 412, width 414, and length 416. Pillow top surface 420 and pillow bottom surface 422 are substantially planar and extend from first side 408 to the second side and from top edge 404 to bottom edge 406.

Pillow body 402 is unitary and includes first body portion 430 and a second body portion 504 extending from first body portion 430. First body portion 430 and second body portion 504 are fabricated from the same material (not shown). In one embodiment, first body portion 430 and second body portion 504 are constructed from a pliable material which may include foam rubber sponge or fiber material. In a second embodiment, first body portion 430 and second body portion 504 are constructed from a down material.

Second body portion 504 is substantially +-shaped and includes a center depression 506 and a plurality of recesses 508. More specifically, depression 506 is centered between top surface 420 and pillow bottom surface 422, and between the pillow second side and pillow first side 408. Center depression 506 extends a distance 510 from a second axis of symmetry 512 that extends between pillow first side 408 and the pillow second side. Distance 510 is less than a distance 514 that pillow top edge 404 and pillow bottom edge 406 are located from second axis of symmetry 512. Furthermore, center depression 506 extends a distance 520 from pillow axis of symmetry 412 that is less than a distance 522 that pillow first side 408 and the pillow second side are located from axis of symmetry 412.

Second body portion 504 defines center depression 506 and includes four identical recesses 508 that are substantially identical recesses 462 and 464 (shown in FIG. 7). More specifically, pillow 500 includes a pair of first recesses 530 extending from pillow first side 408 towards the pillow second side, and a pair of second recesses 532 extending from the pillow second side towards pillow first side 408. Each recess 508 has width 470 and length 472 (shown in FIG. 7), and permit a person to sleep on their side with their head supported by second body portion 504 while their face (shown in FIG. 6) is suspended above recesses 508. Because the person's face is not in contact with pillow 500, facial wrinkling is alleviated while the person is asleep. In one embodiment, pillow second body portion 504 includes two pairs of depressions (not shown) adjacent recesses 508, and extending into pillow 500 approximately 0.5 inches to receive a person's ear (not shown).

The above-described pillow is effective, comfortable, and does not accelerate facial wrinkling. The pillow includes a body which includes a first body portion and a second body portion extending from the first body portion. The first body portion is substantially rectangular-shaped and provides a base for the second body portion which is substantially T-shaped. The second body portion is positioned such that a plurality of recesses extend from the sides of the pillow towards a lower section of the second body portion. Accordingly, an effective and comfortable pillow is provided which inhibits facial wrinkling while a person sleeps.

While the invention has been described in terms of various specific embodiments, those skilled in the art will recognize that the invention can be practiced with modification within the spirit and scope of the claims.

What is claimed is:

1. A pillow comprising:

a first body portion comprising a top edge and a bottom edge connected by a first side edge and a second side edge; and a continuous second body portion extending from said first body portion, said second body portion extending continuously from said top edge to said bottom edge, and continuously between said first and second side edges, said first body portion substantially rectangular-shaped, said continuous second body portion defining at least one recess, said recess bordered only by at least one of said first and said second edges, at least one of said top edge and said bottom edge, and by a continuous sidewall formed by said second body portion, said pillow second body portion further comprising an axis of symmetry extending from said top edge to said bottom edge.

2. A pillow in accordance with claim 1 wherein said first body portion comprises a width, and a length, said width extending between said first side and said second side, said length extending between said top edge and said bottom edge.

3. A pillow in accordance with claim 2 wherein said second body portion includes an upper section and a lower section, said lower section extending substantially perpendicularly from said upper section.

4. A pillow in accordance with claim 3 wherein said second body includes an axis of symmetry substantially co-linear with said pillow axis of symmetry.

5. A pillow in accordance with claim 4 further comprising a first thickness, a second thickness, a top surface, and a bottom surface, said first thickness extending between said top surface and said bottom surface, said second thickness extending between said top surface and said bottom surface, said first thickness further extending along said axis of symmetry between said top edge and said bottom edge, said second thickness further extending along said pillow first side and said pillow second side between said top edge and said bottom edge.

6. A pillow in accordance with claim 3 wherein said second body portion upper section extends between said pillow first side to said pillow second side, said second body portion lower section extends from said pillow top edge to said pillow bottom edge.

7. A pillow in accordance with claim 3 wherein said second body portion upper section comprises a concave outer surface and said second body portion lower section comprises a convex outer surface.

8. A pillow in accordance with claim 3 wherein said second body portion upper section comprises a recess centered between said pillow first and second sides.

9. A pillow (10) (400) comprising:

a substantially rectangular shaped body (12) (402) comprising a first side (18) (408), a second side, a bottom side (16) (406), a top side (14) (404), and a plurality of recesses (62,64) (462, 464) defined only by a continuous wall portion (74,76) (474, 476), at least one of said body bottom side (16) (406) and said top side (14) (404), and at least one of said body first side (18) (408) and said second side, said first side (18) (408) connected to said second side with said top side (14) (404) and said bottom side (16) (406), said plurality of recesses (62, 64) (462, 464) extending from said first side (18) (408) and said second side.

10. A pillow in accordance with claim 9 wherein said plurality of recesses comprises a first recess and a second recess.

11. A pillow in accordance with claim 9 wherein said body comprises a first section and a second section, said plurality of recesses disposed within said second section, said second section extending substantially perpendicularly from said first section.

12. A pillow in accordance with claim 11 further comprising an axis of symmetry extending from said first section to said second section.

13. A pillow in accordance with claim 12 further comprising a first thickness and a second thickness, said first thickness between a pillow top surface and a pillow bottom surface and extending along said axis of symmetry between said body portion first section and said body portion second section, said second thickness between said pillow top surface and said pillow bottom surface and extending along said pillow first edge and said pillow second edge.

14. A pillow in accordance with claim 13 wherein said first section top surface is concave, said second section top surface is convex.

15. A pillow in accordance with claim 13 further comprising a plurality of inserts attached to said pillow within said plurality of recesses.

16. A pillow in accordance with claim 12 wherein said bottom surface of said pillow includes a plurality of ridges extending from said pillow first side to said pillow second side.

17. A pillow in accordance with claim 12 wherein said body comprises a first section and a second section, said plurality of recesses disposed within said second section, said first section comprising a cavity centered between said pillow first and second sides.

18. A pillow in accordance with claim 12 wherein said body defines a cavity, said cavity centered between said pillow first and second sides, and between said pillow top and bottom sides.

19. A pillow in accordance with claim 18 wherein said plurality of recesses spaced circumferentially around said cavity.

20. A pillow in accordance with claim 19 wherein said plurality of recesses comprises four recesses spaced circumferentially around said cavity.

* * * * *